US006735910B1

(12) United States Patent
Fields

(10) Patent No.: US 6,735,910 B1
(45) Date of Patent: May 18, 2004

(54) SPRING LOADED GUTTER HOOK

(76) Inventor: Douglas Wade Fields, 3655 Beechton Rd., Columbus, OH (US) 43232

( * ) Notice: Subject to any disclaimer, the term of this patent is extended or adjusted under 35 U.S.C. 154(b) by 103 days.

(21) Appl. No.: 10/050,772

(22) Filed: Jan. 16, 2002

(51) Int. Cl.[7] ..... E04B 1/72; A01K 69/00
(52) U.S. Cl. ..... 52/101; 52/11; 119/712
(58) Field of Search ..... 52/11, 12, 101, 52/13, 14, 15, 113; 248/48.1, 48.2; 119/712, 738, 750, 1, 758, 769

(56) References Cited

U.S. PATENT DOCUMENTS 4,114,989 A * 9/1978 Badgley ..... 350/302
4,235,038 A * 11/1980 Sauvageau ..... 43/82
4,294,422 A * 10/1981 Odekirk ..... 198/731
4,685,555 A * 8/1987 Smith ..... 198/731
4,817,313 A * 4/1989 Falzon et al. ..... 43/88
4,965,969 A * 10/1990 Antenen ..... 52/12
4,982,550 A * 1/1991 Vidal et al. ..... 52/747
5,586,837 A * 12/1996 Udelle ..... 405/19
5,897,279 A * 4/1999 Bently et al. ..... 411/387
6,405,684 B1 * 6/2002 Ferran et al. ..... 119/801
6,453,622 B1 * 9/2002 Walters ..... 52/12
6,460,811 B1 * 10/2002 Miller ..... 248/48.2
6,568,132 B1 * 5/2003 Walters ..... 52/12

* cited by examiner

*Primary Examiner*—Jeanette Chapman

(57) ABSTRACT

The invention is a spring loaded trap holding device which uses spring tension to securely hold a live animal trap upon the top horizontal plane of a gutter by means of hooking to a gutter spike for the anchoring of the trap. One end of a specific diameter and length of alloy rod is bent to form a hook for the purpose of hooking onto a gutter spike. A large stainless steel flat washer is then placed over the opposite end, followed by a compression spring and then by an aluminum sleeve. The opposite end of the alloy rod is bent to form a 90-degree angle forming a handle and trapping all component parts onto the alloy rod permanently. The gutter hook is placed through the trap from the top allowing the flat washer to rest upon the top of the trap. By applying downward pressure, the spring is then compressed, pushing the hook completely through to the bottom of the trap and is hooked onto the gutter spike, thus securing the trap to the gutter under spring tension.

3 Claims, 4 Drawing Sheets

SPRING LOADED GUTTER HOOK

BACKGROUND OF THE INVENTION

1. Field of the Invention

This invention relates to the ability to securely set and hold a live animal trap upon the gutter of a dwelling by means of hooking to a gutter spike. The invention will provide a secure hold down of the trap with a minimum amount of time and effort.

This invention is designed for Nuisance Wildlife Control Operators. It is common for nuisance wildlife trappers to provide the service of removing wild animals from the roofs, attics and soffits of buildings. Often the ideal placement of their traps is on the gutters of the structure.

2. Description of the Prior Art

Securing traps to gutters can often be a time consuming and tedious job. Some common methods of securing traps to gutters involves the use of wire, screws, screw gun, and/or stretch cords, all of which usually need to be carried up a ladder each time a trap is set or reset. The disadvantages of these methods are the large amount of time, effort, and materials required to complete the job.

SUMMARY

The present invention is to provide a secure hold down of a live animal trap upon the top horizontal plane of a gutter using spring tension. A live animal trap is placed upon a gutter and positioned over a gutter spike. The spring loaded gutter hook is then placed down through the trap until the large flat washer rest on top of the trap. While grasping the handle and pushing the hook end completely through the trap, place the hook end under the gutter spike and release the handle. The spring provides constant upward tension keeping the trap and animal securely hooked to the gutter.

One advantage of the present invention is the elimination of the various materials and tools needed to secure a trap to a gutter. No other tools are necessary with this invention.

Another advantage of the present invention is the ease of use when setting or resetting traps, making it a great time saver.

Yet another advantage of the present invention is that it's virtually impossible for any animal to dis-lodge the trap off of a gutter, whether from inside or outside of the trap.

Still another advantage is that it comes in different lengths to accommodate different sizes of traps.

The spring loaded gutter hook assembly provides a secure holding of a live animal trap to a gutter by means of utilizing the gutter spike and holding the trap under spring tension. All components of this invention are stainless steel, aluminum, or plated steel to aid in rust prevention.

DRAWING FIGURES

In the drawings, closely related figures have the same number but different alphabetic suffixes.

REFERENCE NUMERALS IN DRAWING

10 Alloy rod
10*a* Formed alloy rod
12 Aluminum sleeve
14 Compression spring
16 Stainless steel flat washer
18 Live animal trap.
20 Gutter
22 Gutter spike

DETAILED DESCRIPTION OF THE PREFERRED EMBODIMENT

The following represents a detailed description of the preferred embodiment of the invention, presently considered to be the best made invention when applied to the nuisance wildlife control business.

Figure 1:
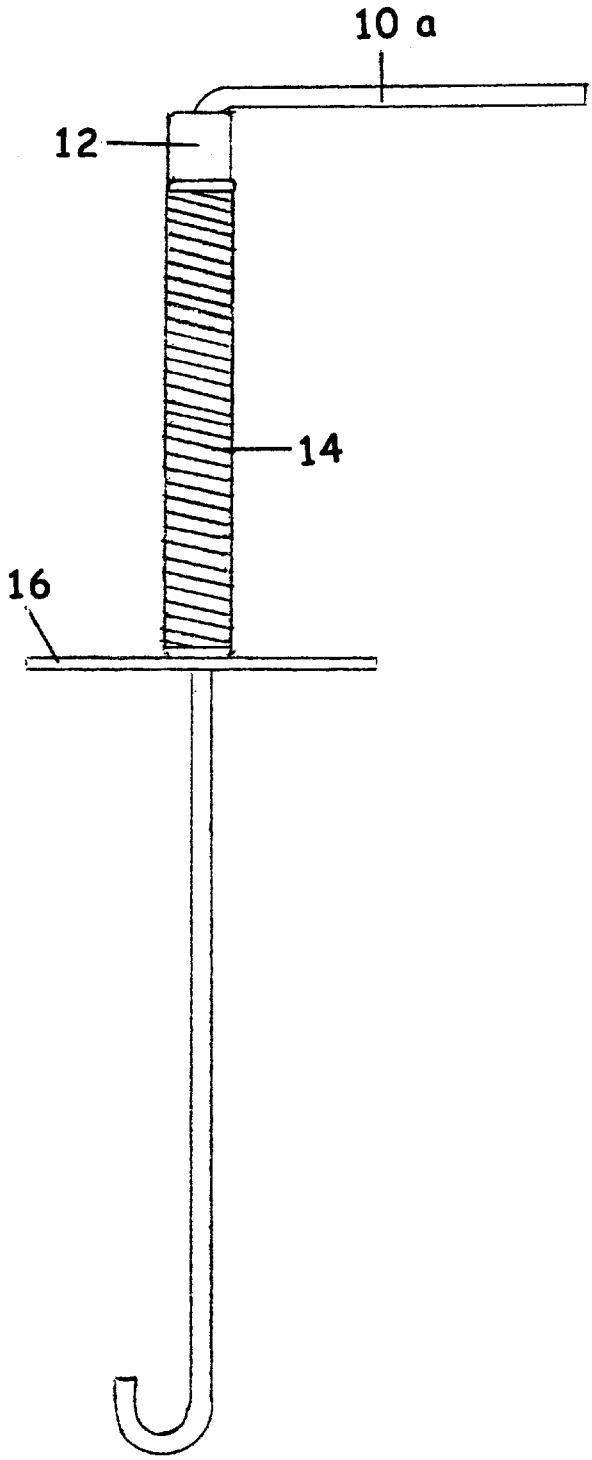
FIG. 1 shows a perspective view of a completely assembled gutter hook.

FIG. 1 shows a perspective view of the spring loaded gutter hook assembly in accordance with the preferred embodiment of the invention seen as it would appear to an individual using the gutter hook. FIG. 1 shows the stainless flat washer 16 positioned under the compression spring 14, which in turn is positioned under the aluminum sleeve 12, all of which are retained on the formed alloy rod 10*a*.

Figure 2:
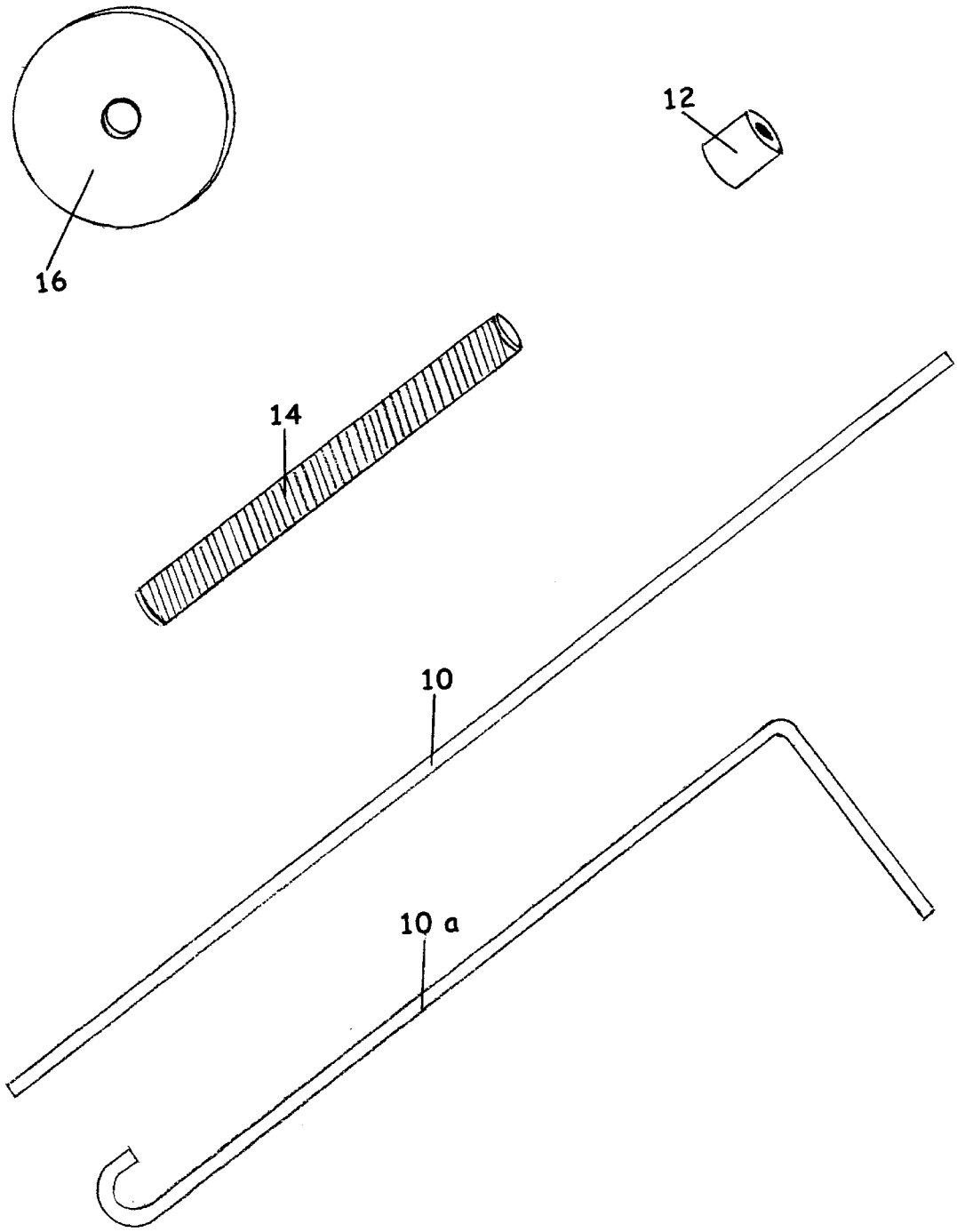
FIG. 2 shows a perspective view of individual component parts of the gutter hook assembly.

FIG. 2 shows a view of the individual component parts of the gutter hook assembly.

Figure 3:
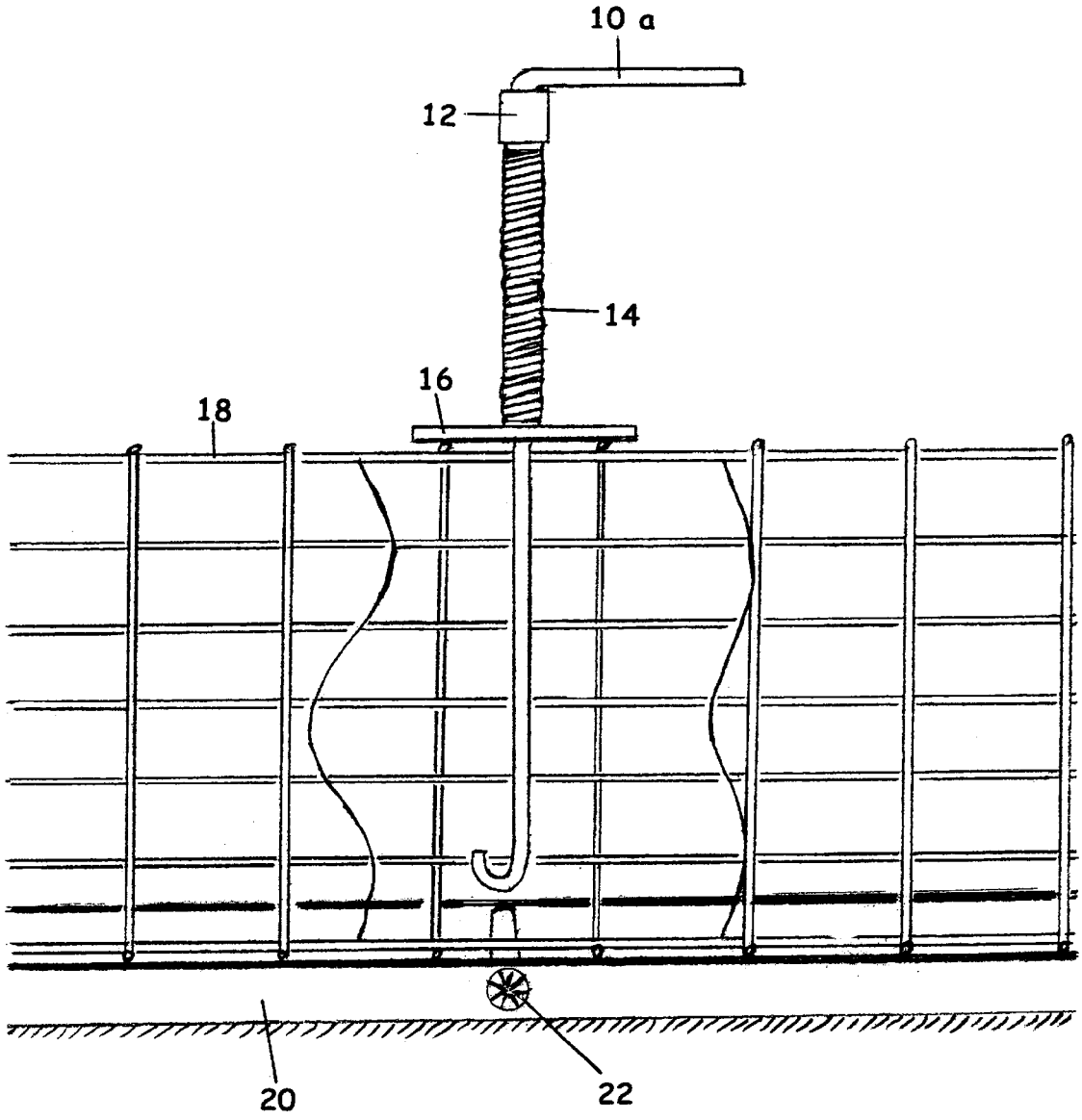
FIG. 3 shows a side view of an animal trap with the gutter hook resting on top of the trap with the spring uncompressed and in a free state.

FIG. 3 shows a side view of an animal trap 18 resting on the top horizontal plane of a gutter 20 with the gutter hook positioned in the top of the animal trap 18, with the spring 14 uncompressed in a free state.

Figure 4:
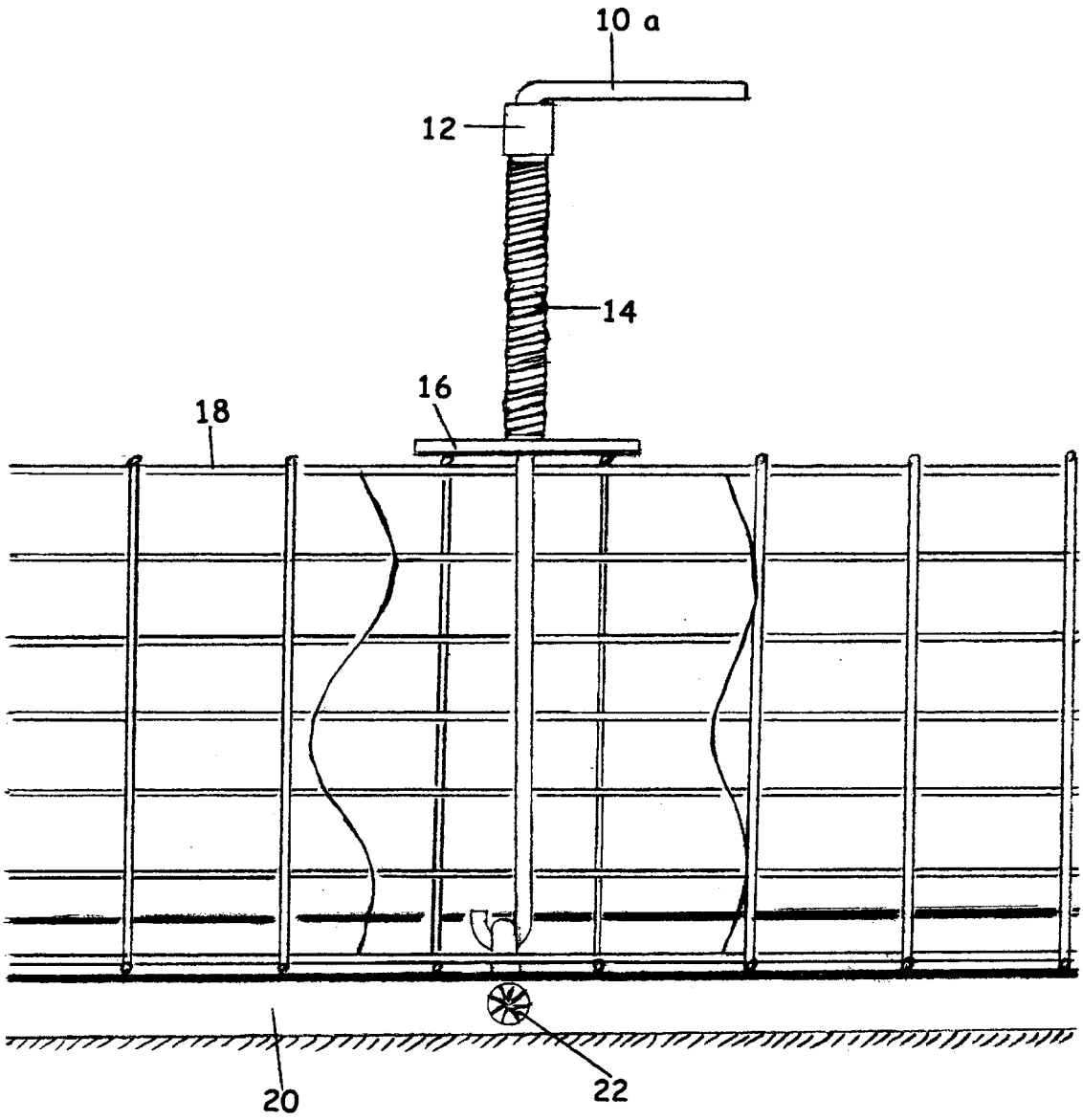
FIG. 4 shows a side view of an animal trap being securely held to a gutter by means of hooking to a gutter spike. Portions of the trap are cut away to show clarity.

FIG. 4 shows a perspective view of the gutter hook assembly securely holding an animal trap 18 to the top horizontal plane of a gutter 20 by means of hooking to a gutter spike 22.

ADVANTAGES

A number of advantages of the spring loaded gutter hook are:

(a) The ability to securely fasten a live animal trap upon a gutter by means of hooking to a gutter spike while holding the trap down under spring tension.

(b) The small amount of time and effort required to set or re-set traps on gutters, thus making it a great time saver.

(c) The elimination of the various tools and materials commonly used to hold traps on gutters such as wire, screws, screw guns, and/or stretch cords.

(d) It is virtually impossible for a wild animal to dislodge a trap from a gutter.

(e) It can be manufactured in different lengths to accommodate various sizes of traps.

OPERATION

The first thing that must be done when using the gutter hook assembly is to place a live animal trap 18 onto a gutter 20, and position the trap 18 over a gutter spike 22.

The hook end of the gutter hook assembly is placed down through the trap 18 directly over the gutter spike 22 allowing the flat washer 16 to rest on top of the trap 18, as shown in FIG. 3.

By grasping the opposite end of the gutter hook assembly and applying downward pressure, the hook is pushed completely through the trap 18 and hooked under gutter spike 22. The live animal trap 18 is secured to gutter 20 under spring tension.

CONCLUSIONS, RAMIFICATIONS AND SCOPE

Accordingly, the reader will see that this invention provides a secure holding of a live animal trap upon the top horizontal plane of a gutter using spring tension. The gutter hook assembly provides a highly reliable, lightweight, yet economical device that can be used with a minimum amount of time and effort. Furthermore, the spring loaded gutter hook has the additional advantages in that:

It can be used on any gutter that uses gutter spikes;

It is made from rust resistant materials;

It provides valuable options to nuisance trappers as to the available placement of their traps;

It provides a quicker, more efficient method of setting live animal traps to gutters.

Alterations or modifications may occur to others upon a reading and understanding of this specification. It is intended to include all such modifications and alterations insofar as they come within the scope of the appended claims and their legal equivalents, rather than by the examples given.

I claim:

1. A gutter hook which uses a spring's tension to safely and securely hold an animal trap upon a top horizontal plane of a gutter by means of hooking said animal trap onto a gutter spike, said hook comprises:

a.) a formed alloy rod of a specific diameter and of a length that is determined by the size of said animal trap that it is made for, said rod having a hook formed at one end for the purpose of hooking onto said gutter spike and having a measured length on an opposite end which is formed 90 degrees in the opposite direction of the said hook forming a handle;

b.) an alloy flat washer of a measured outside diameter with a specific sized hole and thickness as such that it will pass over said alloy rod, but will not pass over said formed hook and said flat washer serves as a surface area that pushes against a top of said animal trap;

c.) a compression spring of a measured length and diameter with a specific diameter wire providing spring tension when holding said trap on said gutter; said spring passes over the alloy rod and extends above said flat washer providing spring tension;

d.) an aluminum sleeve of a measured length and diameter with a specific sized hole allowing it to pass over said alloy rod before said handle is formed; said sleeve serves as a retainer and stop.

2. A combination animal trap and gutter hook;

said hook securely holds said animal trap upon a top horizontal plane of a gutter by means of hooking said animal trap onto a gutter spike;

said hook comprises:

a.) a formed alloy rod of a specific diameter and of a length that is determined by the size of said animal trap that it is made for, said rod having a hook formed at one end for the purpose of hooking onto said gutter spike and having a measured length on an opposite end which is formed 90 degrees in the opposite direction of the said hook forming a handle;

b.) an alloy flat washer of a measured outside diameter with a specific size hole and thickness as such that it will pass over said alloy rod, but will not pass over said formed hook and said flat washer serves as a surface area that pushes against a top of said animal trap;

c.) a compression spring of a measured length and diameter with a specific diameter wire providing spring tension when holding said trap on said gutter; said spring passes over the alloy rod and extends above said flat washer providing spring tension;

d.) an aluminum sleeve of a measured length and diameter with a specific size hole allowing it to pass over said alloy rod before said handle is formed; said sleeve serves as a retainer and stop.

3. Said combination of claim 2 further comprises said gutter hook inserted down through a top of said animal trap and said hook of part a.) engages with said gutter spike and said flat washer is resting on top of said animal trap.

* * * * *